US005954378A

United States Patent [19]

Forgue

[11] Patent Number: 5,954,378

[45] Date of Patent: Sep. 21, 1999

[54] LIFTING TOOL

[76] Inventor: David R. Forgue, 25 Teele St., Arlington, Mass. 02174

[21] Appl. No.: 08/872,241

[22] Filed: Jun. 10, 1997

[51] Int. Cl.[6] ..... B66C 1/62

[52] U.S. Cl. ..... 294/91; 294/67.1

[58] Field of Search ..... 294/1.1, 15, 27.1, 294/31.2, 32, 34, 67.1, 67.22, 67.3, 86.33, 90, 91, 162, 163

[56] References Cited

U.S. PATENT DOCUMENTS

| | | | |
|---|---|---|---|
| 416,246 | 12/1889 | Abrams | 294/91 |
| 1,412,054 | 4/1922 | Hagerman | 294/34 |
| 1,531,902 | 3/1925 | Cunningham | 294/91 |
| 1,535,022 | 4/1925 | Jenkins . | |
| 1,684,995 | 9/1928 | Kennard | 294/31.2 X |
| 2,300,370 | 10/1942 | Lowery | 294/91 |
| 3,215,464 | 11/1965 | Overman . | |
| 3,751,097 | 8/1973 | Jones et al. . | |
| 3,905,633 | 9/1975 | Larson . | |
| 3,995,903 | 12/1976 | Ernst . | |
| 4,058,339 | 11/1977 | Burchard | 294/91 |
| 4,534,588 | 8/1985 | Markey . | |
| 4,632,442 | 12/1986 | Gerding . | |
| 4,762,239 | 8/1988 | Wissman et al. . | |
| 4,951,989 | 8/1990 | Goodin . | |
| 5,246,068 | 9/1993 | Besson . | |
| 5,513,887 | 5/1996 | Devening | 294/67.22 |

*Primary Examiner*—Johnny D. Cherry
*Attorney, Agent, or Firm*—Hamilton, Brook, Smith & Reynolds, P.C.

[57] ABSTRACT

A lifting tool comprises a lifting plate having a bifurcation. A pair of guide rods extend upwardly from the lifting plate. A keeper plate is slidable on the guide rods toward and away from the lifting plate. The keeper plate has centering mechanism and the lifting plate has adjusting mechanism for varying size of the bifurcation.

18 Claims, 6 Drawing Sheets

LIFTING TOOL

BACKGROUND OF THE INVENTION

This invention is directed to lifting tools or mechanisms in general and, more particularly, to apparatus for lifting heavy, bulky objects of somewhat irregular configuration. The apparatus is ideally suited to lifting fluid control apparatus such as control valves, gate valves, ball valves and flanged pipe joints. It has particular usage with water control valves and hydrants of the types generally installed in municipalities. Mechanisms of this type are usually so heavy that they cannot be lifted by a person and, in many instances, two or three strong men cannot lift them.

Many gate valves and at least the shoe portion of fire hydrants are located underground. Thus, the valve or hydrant must be lifted, lowered into a pre-dug hole or trench in a precise manner, which is called hydrant setting, then it is connected to a water supply pipe. This requires not only moving the valve to its ultimate destination where it will be joined to a supply pipe but, generally, a number of instances of vertical lifting and lowering are encountered in the process.

Before such apparatus is finally connected to the water system, it must be moved from the manufacturer's assembly line or location to a storage area, either in a storage shed or a storage yard. It must be lifted again to a truck or freight car for transportation to a dealer or contractor. It must be lifted again at the dealer's premises and, yet again, it must be lifted and transported to the site on which it will be permanently installed. The lifting and hauling is obviously not done by the same persons. The manufacturer must have a crew and the dealer, the retailer and the construction company must all have crews of trained men to do this.

More often than not, the actual lifting and positioning of a gate valve or hydrant is accomplished by wrapping and locking a chain around it, attaching the chain to a hoist and then swinging the valve onto a truck or, when it is being installed, into a pre-dug hole or trench. Not only does the wrapping of the chain require skill, but the technique is susceptible to error with the possibility of the valve crashing down where it could injure humans or damage other equipment. Thus, there is a need for simple, dependable lifting mechanisms for this type of apparatus.

One such device called a "Fire Hydrant Setting Tool" is disclosed in U.S. Pat. No. 4,951,989 to Goodin. It has a planar lifting plate which, when assembled on an object to be lifted, must be latched into position and then locked to prevent unlatching.

Another such device called "Tool for Lifting and Installing a Fire Hydrant or the Like" is disclosed in U.S. Pat. No. 3,215,464 to Overman and includes a plurality of hook-like members which are placed over the cap or bonnet of a hydrant and then chained into place.

It is an object of the present invention to provide a lifting tool for such apparatus which is inexpensively made, universal in its operation and can be used by workmen not requiring the particular skill of chain wrapping.

Another object of the invention is to produce a lifting tool which is simple, foolproof and readily used by a person having little or no prior training.

SUMMARY OF THE INVENTION

The invention resides in a lifting tool for valves, hydrants and like apparatus. It includes a substantially horizontal lifting plate. The plate has a bifurcation in the shape of an inverted U extending from one edge substantially into the middle of the plate, the plate being essentially rectangular in configuration. There are a pair of parallel guide rods extending upwardly at right angles from the lifting plate. A keeper plate is slidable on the guide rods toward and away from the upper surface of the lifting plate. The keeper plate has a load centering mechanism and, thus, may also be called a centering plate. A bridge joins the upper ends of the guide rods and forms a lifting loop.

In operation, the lifting plate is slid under the flange of a flanged operating nut on the article to be lifted with the bifurcation straddling the nut. Such a nut is usually on the top of the bonnet of a hydrant. The plate may even be placed under the flange which joins the bonnet to the main body portion of either the hydrant or a conventional gate valve.

The keeper or centering plate is initially held at the upper end of the parallel guides and then lowered on the guide rods. There is an aperture in the centering plate that fits over the valve nut projecting from the top of the bonnet. Before the lifting mechanism is raised by a chain having a hook that engages the bridge, the centering or keeper plate self-adjusts relative to the projecting nut moving laterally or either inwardly or outwardly a slight amount, such that the keeper plate becomes centered relative to the nut which projects through the aperture. Once it is centered, the hook and chain are raised with the lifting plate then forcibly engaging the bottom of the flange of the object being lifted. The centering or keeper plate, which engages the projection on the hydrant or valve on all sides, not only prevents the object being lifted from moving laterally with regard to the bifurcated lifting plate, it prevents it from moving outwardly of the bifurcation in the lifting plate.

The centering mechanism, usually an aperture in the centering plate, may be in the form of a circle or a polygon of any selected number of sides and sizes.

The centering mechanism may also include an apertured plate which is removably secured to the centering plate and which may be replaced by like plates but having different size or shaped apertures, the plate being selected to fit over the projecting nut of the particular valve or hydrant being lifted.

The centering mechanism may also include a downwardly projecting dome on the bottom of the centering plate which would be used in the case of lifting a flanged pipe, the lifting plate sliding under the flange and the dome of the keeper plate sliding downwardly into the opening of the pipe.

Adjusting mechanism is also provided to laterally reduce the size of the U-shaped bifurcation. There is at least one arcuate adjustable plate mounted for sliding movement on the lifting plate and secured to it by bolts threaded into the adjustable plate and movable within lateral slots in the lifting plate per se. There may be one or a plurality of such plates, for example, two plates movable toward one another, either in parallelism or, at an angle so they may be cocked in order to clamp the object being lifted within the bifurcation.

The above and other features of the invention including various and novel details of construction and combination of parts will now be more particularly described with reference to the accompanying drawings and pointed out in the claims. It will be understood that the particular lifting mechanism embodying the invention is shown by way of illustration only and not as a limitation of the invention. The principles and features of this invention may be employed in varied and numerous embodiments without departing from the scope of the invention.

DETAILED DESCRIPTION OF THE INVENTION

Figure 1:
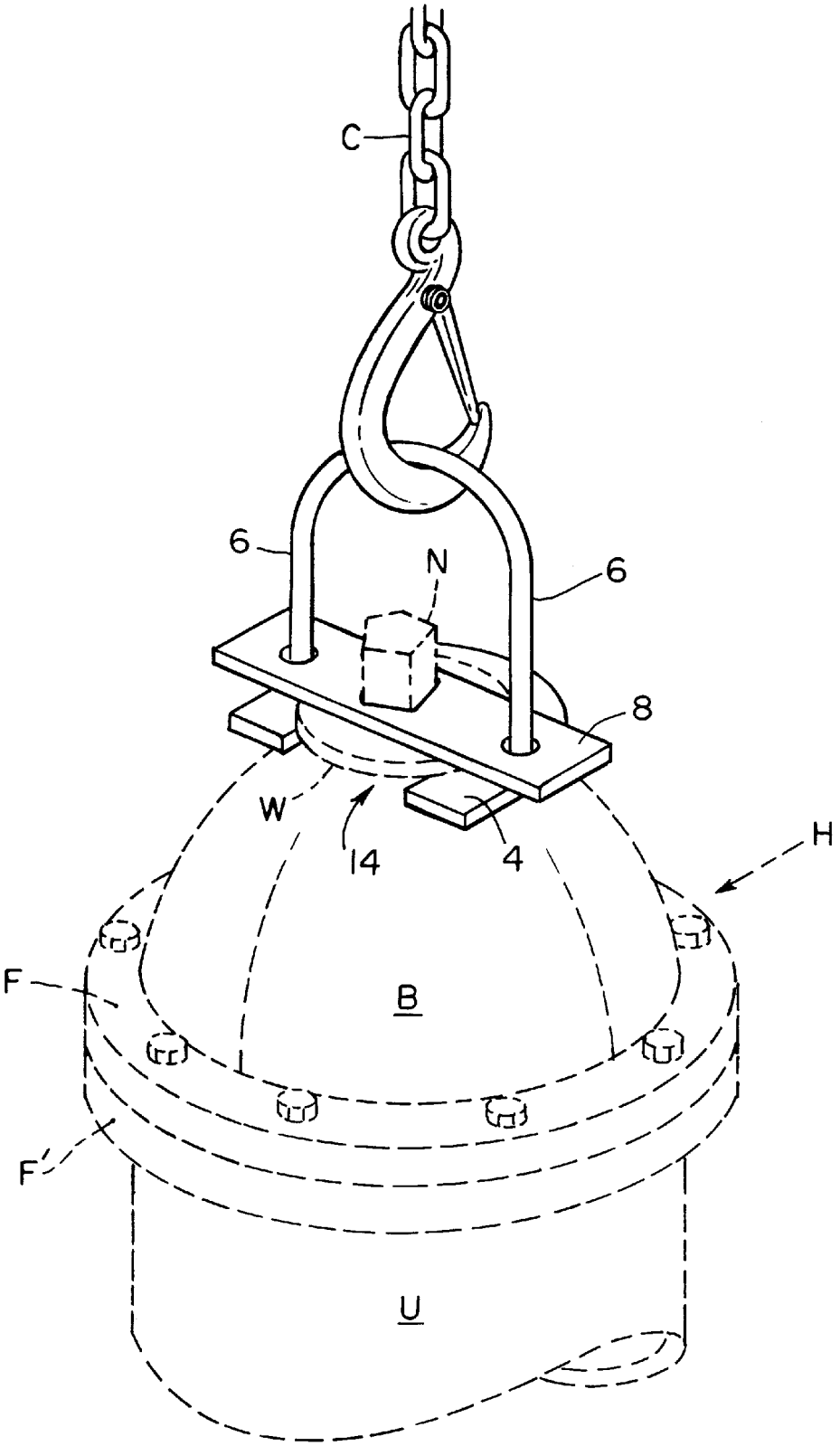
FIG. 1 is a perspective view of a lifting tool made in accordance with the present invention and applied to a fire hydrant.
Figure 2:
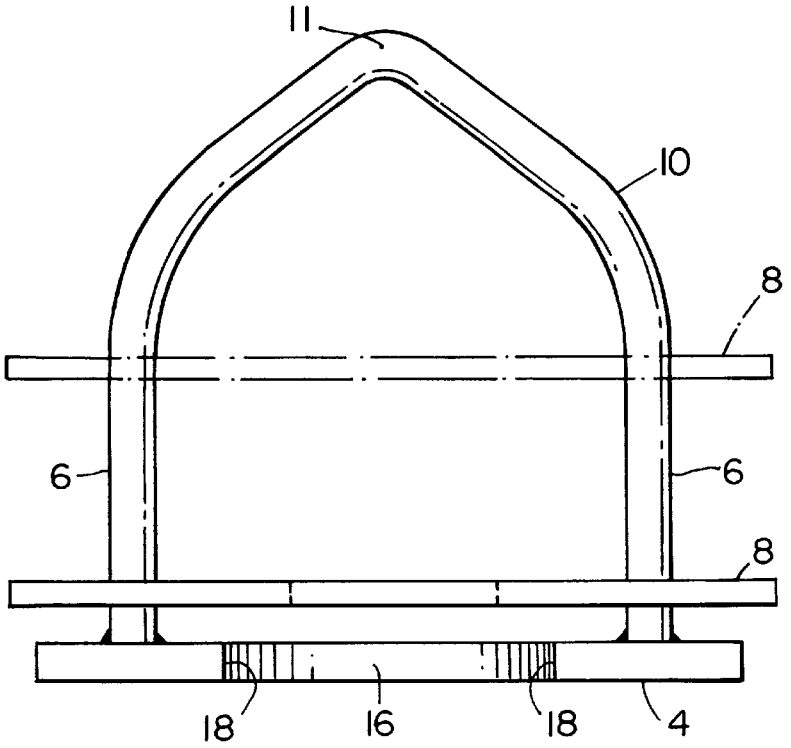
FIG. 2 is a front view of the lifting tool on enlarged scale.
Figure 3:
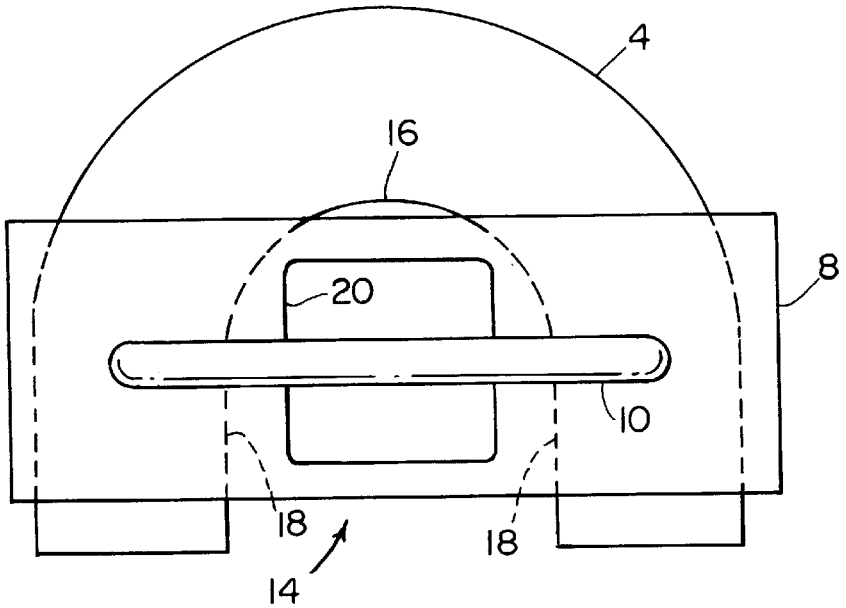
FIG. 3 is a top view of the lifting tool on enlarged scale.

Referring first to FIGS. 1–3, the lifting tool embodying the features of the present invention will be described in its basic form. Whereas the mechanism is ideally suited for lifting of gate valves, it is illustrated with respect to a common fire hydrant H having a cap or bonnet B terminating in a flange F joined to a flange F' which is part of the upper barrel U. The below ground portion of a conventional fire hydrant includes a lower barrel, not shown, terminating in a shoe or elbow which in turn is connected to a water supply. The hydrant includes the conventional operating nut N with a flanged weather shield W.

The operating nuts N of conventional fire hydrants are generally pentagonal in cross-section and can be opened only with pentagonal wrenches which form part of conventional fire fighting apparatus. The nut N, in turn, is connected to a main compression valve inside the bottom of the hydrant and is not seen. The valve opens against pressure and closes with pressure of the water in the main supply line. None of the above-described mechanism constitutes the subject invention but is merely described here for background purposes. While a weather shield W is shown integral with the nut N and elevated from the bonnet B, this is not the case with all hydrants. Consequently, the subject lifting apparatus would be of larger construction to fit beneath the mating flange F'.

Figure 7:
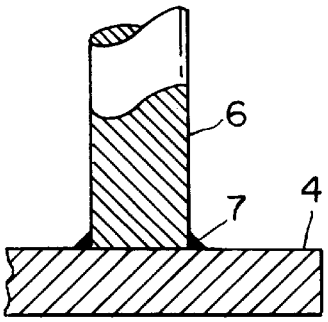
FIGS. 7 and 8 are cross-sectional showings of the parallel guides and the manner in which they are welded to the lifting plate.
Figure 8:
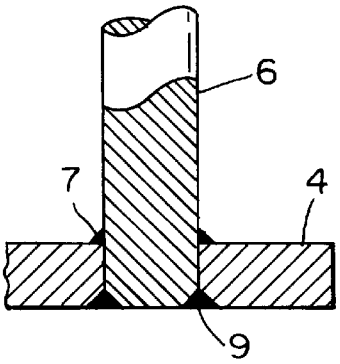

Referring next to FIGS. 2 and 3, the lifting tool per se comprises a bifurcated lifting plate 4 with a pair of parallel guides 6 projecting at right angles from the lifting plate. The guides may be secured to the lifting plate by abutting them and then securing them with an annular weld 7 i.e., a single sided weld as seen in FIG. 7. A better technique, however, is to drill the plate 4, insert the guides through the plate as shown in FIG. 8 and secure them by a double sided weld comprising the annular weld 7 and, in addition, by a circular weld 9 which may be ground off keeping the lifting plate 4 flat. The welds 7 and/or 9 assure that the guides 6 are rigidly and immovably secured to the lifting plate.

A centering or keeper plate 8 slides up and down on the guides 6 parallel to the bifurcated lifting plate 4. A bridge 10 extends from the upper ends of the parallel guides 6 and may be either semi-circular as shown in FIG. 1 or have an apex 11 as shown in FIG. 2. The purpose of the bridge is to form a loop to receive the hook of a lifting chain C (as seen in FIG. 1). When lifted, the weight of the valve or hydrant will cause the hook to center itself relative to the semicircular bridge or at the apex 11 of the FIG. 2 bridge.

In order that the keeper plate 8 may slide freely on the guide rods 6, the keeper plate is provided with spaced holes 12 (FIG. 10) slightly larger than the parallel guide rods and having a center-to-center distance which is the same as the center-to-center distance of the guide rods 6.

The lifting plate 8 has a bifurcation 14 in the shape of an inverted U centrally located relative to the guide rods 6. It has a curvilinear portion 16 partially forming the U, and straight parallel sides 18.

Figure 4:
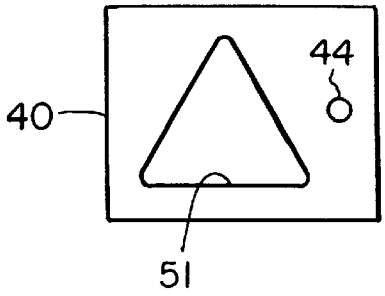
FIGS. 4, 5 and 6 are top views of interchangeable secondary plates for use on the keeper plate and having apertures of differing configurations.
Figure 5:
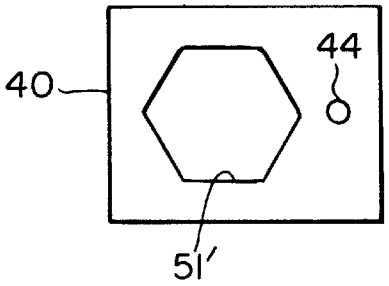
Figure 6:
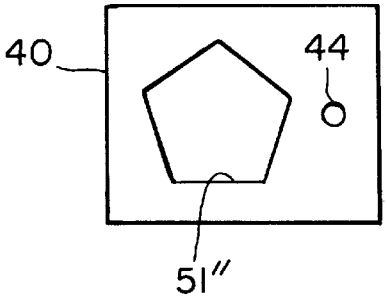
Figure 10:
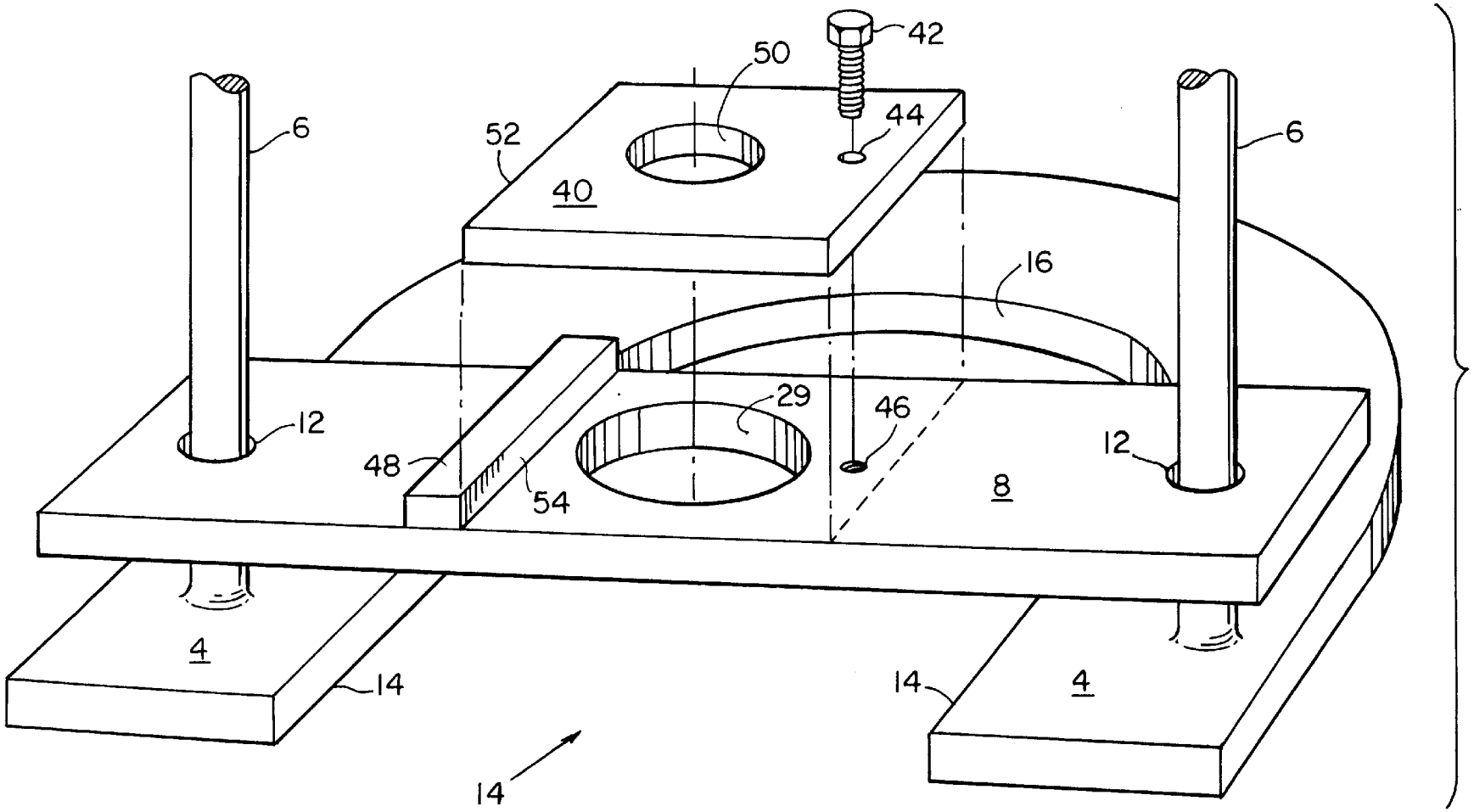
FIG. 10 is a perspective view of a portion of the lifting tool showing the entering or keeper plate having a removable, interchangeable, supplemental plate.

The centering or keeper plate 8 has load centering mechanism, in this instance, in the form of an aperture 20 formed directly in the plate as, for example, in FIG. 3. The aperture 20 is illustrated in the form of a square which is intended to accommodate a square nut N found on most control valves. In the case where the nut N is on a fire hydrant, the aperture 20 would be a pentagon 51" (FIG. 6). The aperture may be any polygon such as a hexagon 51' (FIG. 5) or a triangle 51 (FIG. 4). In most instances, however, the aperture would be a circle 29 as seen in FIG. 10.

Figure 9:
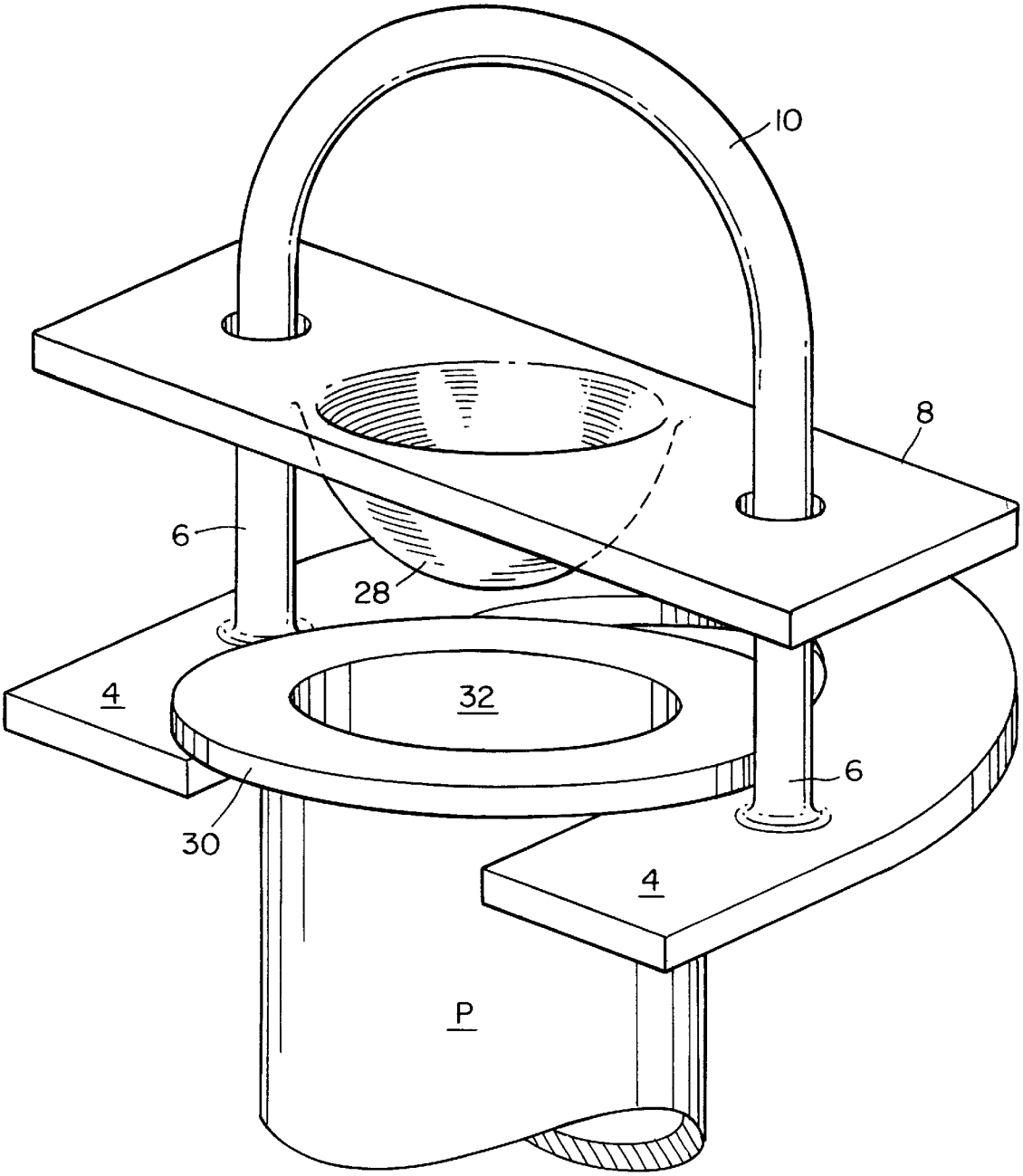
FIG. 9 is a perspective view of the lifting tool having a centering mechanism in the form of an inverted dome.

The load centering mechanism may also take the form of an inverted dome 28 as seen in FIG. 9. In this instance, the lifting mechanism would be used to lift a flanged pipe P having a circular projecting flange 30. The dome 28 will fit into the interior of the pipe.

In operation, the lifting tool operates as follows. It is lowered by hoisting mechanism including a hook and chain C. The bifurcated lifting plate 4 is slid manually under the weathershield W as shown in FIG. 1 or the flange 30 seen in FIG. 9. It may also be slid under the flange F' of the hydrant. The only difference is one of size, not in the principle of operation. The centering plate 8 is placed over the nut N which projects through the aperture in the plate or the dome 28 enters the flanged pipe as shown in FIG. 9. Before the lifting plate 4 is raised, the centering plate 8 adjusts itself relative to the lifting plate 4 and relative to the load when the keeper plate is slid down the guide rods 6. Thereafter, the chain C is lifted and the gate valve or hydrant or other similar piece of apparatus is lifted upwardly.

It will be noted that there is no need to lock the plates together; there is no need to secure multiple portions of the lifting plate 4 together and no locking chain is needed. The welds 7 and/or 9 effectively make the guide rods 6 and the lifting plate 4 a unitary structure without the ability to pivot relative to one another. The bifurcation sidewalls 18 prevent the hydrant from moving laterally and the keeper plate itself keeps the nut N within the bifurcation 14 since it can only move vertically up and down on the parallel guide rods 6, not laterally, inwardly or outwardly.

The keeper plate 8 may be constructed to receive a series of removable, secondary apertured plates. The plate 8 is provided with a centering aperture 29 of comparatively large diameter. A removable secondary plate 40 having a smaller aperture 50 is secured to the upper side of a keeper plate 8 by a screw 42 passing through a hole 44 in the plate 40 and into a threaded hole 46 in the keeper plate. The keeper plate 8 is provided with a bar 48 which extends at right angles to the plate per se to position the plate 40 accurately relative to the plate 8. An edge 52 engages a mating edge 54 on the bar 48 to prevent the plate from rotating relative to the keeper plate. Whereas the aperture 50 (FIG. 10) in the removable plate 40 is shown as circular, it may be of any desired configuration, see FIGS. 4, 5 and 6. Thus, a lifting tool made in accordance with the FIG. 10 embodiment is not restricted to an object of a single size but may be supplied with a plurality of secondary plates 40 to make it adaptable to objects of differing sizes and configurations.

Figure 11:
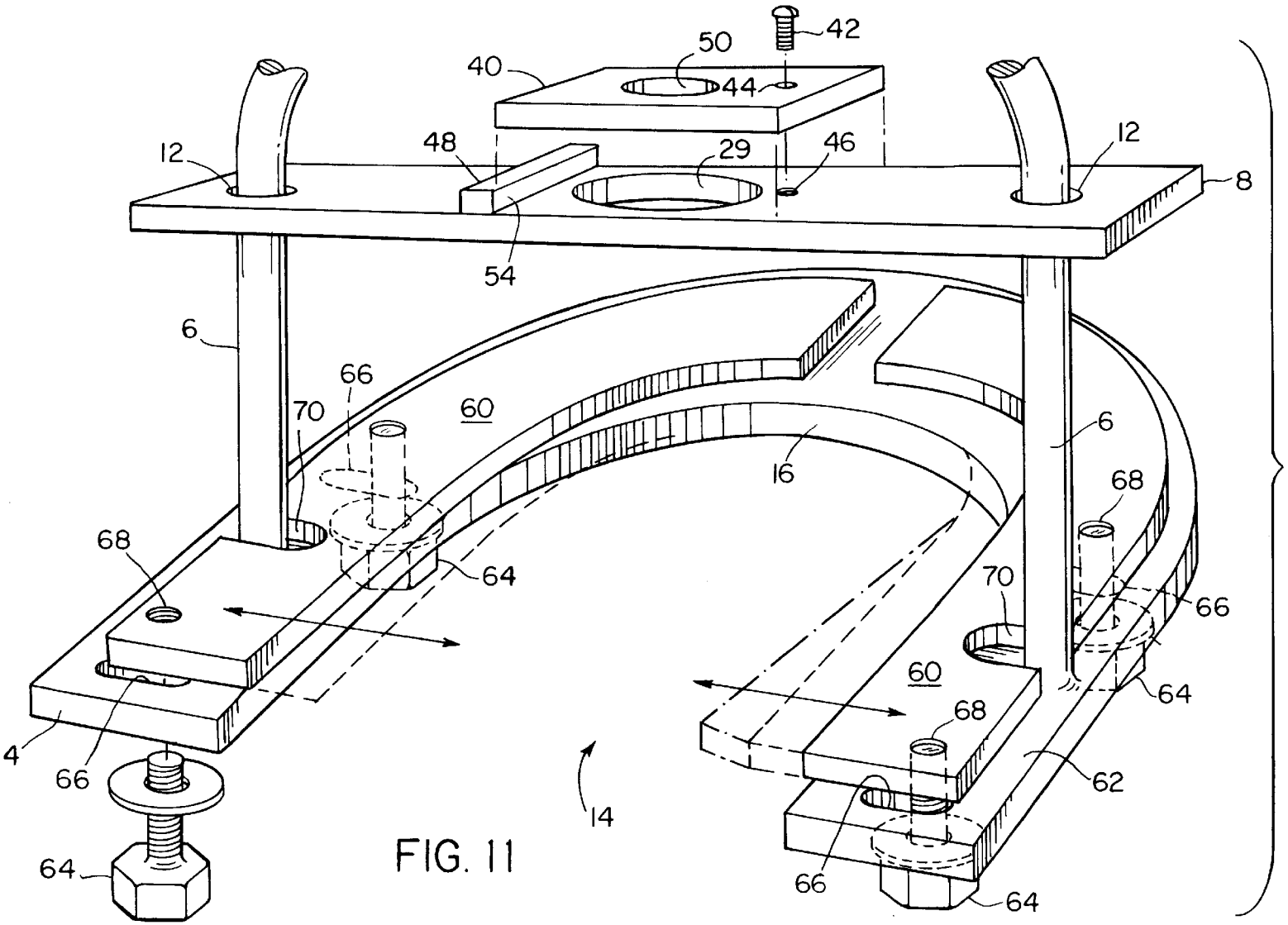
FIG. 11 is a perspective view of the lifting tool having adjusting mechanism on the lifting plate for reducing the size of the U-shaped bifurcation.

The bifurcation 14 in the lifting plate 4 may be adjustable to provide a narrower side to side opening as measured in the directions of the arrows in FIG. 11. Mechanism for making such openings smaller comprises at least one curvilinear adjusting plate 60 mounted on the upper surface 62 of lifting plate 4. It is movable from the solid to the dotted line positions. Bolts 64 pass through elongated slots 66 in the lifting plate 4 and are threaded in holes 68 in the adjusting plates. The adjusting plates are provided with slots 70 parallel to the slots 66 to accommodate the guide rods 6 as they are moved toward and away from the U-shaped bifurcation.

If it is desired to clamp either or both of the adjusting plates around the object to be lifted, the bolts nearest the open end of the bifurcation would be located at the inner ends of the slots 66 and, conversely, the bolts away from the opening would be positioned at the outermost end of the slots 66 which would assist the keeper plate 8 in preventing the lifting mechanism from moving out from beneath the flange from which it is bearing against.

The invention claimed is:

1. A lifting tool comprising:

a lifting plate having a substantially planar upper surface and a bifurcation;

a pair of parallel guide rods extending from the upper surface of the lifting plate;

the guide rods being rigidly and immovably secured to the lifting plate;

a keeper plate slidable on the guide rods toward and away from the lifting plate;

the keeper plate having load centering mechanism for confining an object, on all sides, when being lifted to prevent lateral movement of this object relative to the lifting tool; and a bridge joining the guide rods and forming a lifting loop.

2. A lifting tool as claimed in claim 1, wherein the load centering mechanism in the keeper plate is in the form of an aperture.

3. A lifting tool as claimed in claim 2, wherein the aperture of the load centering mechanism in the keeper plate is a circle.

4. A lifting tool as claimed in claim 2, wherein the aperture of the load centering mechanism in the keeper plate is a polygon.

5. A lifting tool as claimed in claim 1, wherein the load centering mechanism in the keeper plate is an inverted dome.

6. A lifting tool according to claim 1, wherein the bridge is arcuate.

7. A lifting tool according to claim 1, wherein the bridge forms an apex.

8. A lifting tool, comprising:

a lifting plate having substantially planar upper surface and a bifurcation;

a pair of parallel guide rods extending from the upper surface of the lifting plate substantially normal thereto;

the guide rods being rigidly and immovably secured to the lifting plate;

a keeper plate slidable on the guide rods toward and away from the lifting plate;

the keeper plate having load centering mechanism;

a bridge joining the guide rods and forming a lifting loop; and the load centering mechanism in the keeper plate being in the form of an aperture engagable with an object on all sides when being lifted to prevent lateral movement of the object relative to the lifting tool.

9. A lifting tool in accordance with claim 8, wherein the aperture is formed in a secondary centering plate removably secured to the keeper plate.

10. A lifting tool in accordance with claim 8, wherein there are a plurality of secondary centering plates each removably securable to the keeper plate, each centering plate having an aperture of different size or configuration.

11. A lifting tool comprising:

a lifting plate having a bifurcation;

a pair of parallel guide rods extending from the lifting plate;

a keeper plate slidable on the guide rods toward and away from the lifting plate;

the keeper plate having load centering mechanism;

a bridge joining the guide rods and forming a lifting loop;

adjusting mechanism movably mounted on the lifting plate for varying the size of the bifurcation.

12. A lifting tool as claimed in claim 11, wherein the adjusting mechanism comprises at least one arcuate plate.

13. A lifting tool as claimed in claim 11, wherein the adjusting mechanism comprises at least two arcuate plates.

14. A lifting tool as claimed in claim 11, wherein the load centering mechanism in the keeper plate is in the form of an aperture.

15. A lifting tool as claimed in claim 14, wherein the aperture of the load centering mechanism in the keeper plate is a circle.

16. A lifting tool as claimed in claim 14, wherein the aperture of the load centering mechanism in the keeper plate is a polygon.

17. A lifting tool as claimed in claim 1, wherein the guide rods are rigidly and immovably secured to the lifting plate by a single sided weld.

18. A lifting tool as claimed in claim 1, wherein the guide rods are rigidly and immovably secured to the lifting plate by a double side weld.

* * * * *